US005924264A

United States Patent [19]

Vierra

[11] Patent Number: 5,924,264

[45] Date of Patent: Jul. 20, 1999

[54] CONCRETE FOOTING AND FOUNDATION WALL SYSTEM FOR ACCURATE ON-SITE FITTINGS TO MANUFACTURED BUILDINGS

[76] Inventor: Douglas L. Vierra, 1231 San Felipe Rd., Hollister, Calif. 95023

[21] Appl. No.: 08/934,039

[22] Filed: Sep. 19, 1997

[51] Int. Cl.[6] ..... E02D 27/00; E04G 11/20

[52] U.S. Cl. ..... 52/741.15; 52/274; 52/293.3; 52/294; 52/742.14; 52/745.12; 249/34; 249/93; 249/219.1

[58] Field of Search ..... 52/274, 292, 293.1, 52/293.3, 294, 741.15, 742.14, 745.12; 249/3, 34, 47, 91, 93, 219.1

[56] References Cited

U.S. PATENT DOCUMENTS

| | | | |
|---|---|---|---|
| 2,298,837 | 10/1942 | Oswald | 249/34 |
| 2,581,521 | 1/1952 | Davis | 52/293.1 X |
| 2,711,573 | 6/1955 | Bliss | 249/219.1 X |
| 3,077,652 | 2/1963 | Hillberg | 249/219.1 X |
| 3,171,185 | 3/1965 | Anderson | 249/34 |
| 3,195,852 | 7/1965 | Lundell | 249/34 |
| 3,207,465 | 9/1965 | Papin | 249/34 |
| 4,029,288 | 6/1977 | Murphy et al. | 249/219.1 X |
| 4,339,106 | 7/1982 | Navarro | 249/219.1 |
| 4,457,118 | 7/1984 | Bowen | 52/741.15 X |
| 4,494,725 | 1/1985 | Sims | 249/219.1 |
| 5,052,654 | 10/1991 | Means et al. | 249/91 X |
| 5,156,753 | 10/1992 | Speidel | 249/219.1 X |
| 5,240,224 | 8/1993 | Adams | 249/93 |
| 5,511,761 | 4/1996 | Schultz | 249/34 |

*Primary Examiner*—Carl D. Friedman
*Assistant Examiner*—Timothy B. Kang
*Attorney, Agent, or Firm*—Thomas E. Schatzel; Law Offices of Thomas E. Schatzel, A Prof. Corporation

[57] ABSTRACT

A foundation system comprises a prefabricated set of concrete forms for a manufactured building that is already on-site and in-place. The concrete form set includes standard-length sections that bolt together immediately below the rim of the manufactured building. The inside sidewall of each concrete form is tilted back toward the outside perimeter and the outside sidewall is set vertical within both end frames and any intermediate frames. Anchor rings are provided at the ground level of each frame to accommodate four foot lengths of rebar that are driven through the rings into the ground to spike the concrete form to the ground. Jigs are used to suspend anchor bolts in the open tops of the forms between the two sidewalls. Once the concrete pour has been made and allowed to set, the concrete forms are unbolted and the ground spikes withdrawn. The tilt in the inside sidewall allows the concrete forms to be easily popped off. A pony wall is then built up between the top of the concrete footing and the rim of the manufactured building using dimensional lumber and plywood.

3 Claims, 5 Drawing Sheets

CONCRETE FOOTING AND FOUNDATION WALL SYSTEM FOR ACCURATE ON-SITE FITTINGS TO MANUFACTURED BUILDINGS

BACKGROUND OF THE INVENTION

1. Field of the Invention

The invention relates generally to building construction and more specifically to concrete footings and foundation wall systems for prefabricated manufactured buildings that are brought onto a construction site.

2. Description of the Prior Art

Manufactured buildings and homes are typically built in modular sections that are each permanently supported by a pair of "transporter" beams. The walls are not directly supported by such transporter beams, and yet represent one of the greatest loads. Sometimes gussets off of the transporter beams are used that reach out to points on the perimeter rim under the outside walls, but such measures are inadequate over the life of the building. A substantial portion of the total weight of a manufactured building is represented by the walls themselves and the roof loads carried by them.

Nevertheless, the manufacturers of such buildings invariably specify only the use of jacks and blocks that support the transporter beams, marriage ridge beam, etc., at the final construction site. A complete installation that satisfies the local, state, and federal building codes for manufactured buildings can and often is done without providing a solid foundation support directly beneath the outside perimeter walls. Such a wall could help to dramatically reduce the flexing stresses borne by the manufactured building, and add a large measure of protection against seismic damage and wind.

It has been customary for people who were buying manufactured houses to have a foundation contractor build a concrete foundation on-site according to plans supplied by the building manufacturer. In an ideal world this will work fine, but in the real world there are always variations in the manufacturing process that can lead to surprises when the building is finally delivered to the site. For example, a bay window can be included that will not occur in the standard plan but will have to be provided for in the actual installation of the foundation because the outside wall and flooring outline are changed. Most factories simply supply generic plans that do not reflect custom details.

In general, federal and state building codes require manufactured homes to be permanently attached to a foundation by anchoring devices that are adequate to resist all the loads, for example as identified in the Code of Federal Regulations, 24 CFR 200.926d. Such can be satisfied without a perimeter support, e.g., supporting just the transporter beams. These requirements specify the minimum resistance to ground movements, seismic shaking, potential shearing, overturning and uplift loads caused by wind, earthquake, etc. Anchoring straps or cables affixed to ground anchors other than footings or piers will generally not meet the requirements. The manufactured building unit must be anchored to the footing or pier, e.g., forty such piers each rated for 5,000 pounds are typical in an ordinary installation. Permanent utilities must be installed and protected from freezing. And in most cases, towing hitches, running gear including tongues, axles, brakes, wheels, and lights, must be removed, leaving behind the chassis which must stay in place.

In general, the law requires that the crawl spaces be enclosed with a continuous permanent foundation-type construction similar to a conventionally built foundation, e.g., concrete, masonry or treated wood. If the perimeter enclosure is separate from the supporting foundation, it must be designed to resist all the credible forces to which it may be subjected to. The manufactured unit must be secured to the perimeter of the unit to exclude the entry of vermin and water, and yet allow good ventilation of the crawl space. Any movements or effects caused by frost heave, soil settlement consolidation, or the shrinking or swelling of expansive soils must not be transmitted to the building superstructure. Such perimeter structure generally is not actually required by the law to provide support to the building unit. However local building codes may require specialized techniques to suit the existing soil conditions.

SUMMARY OF THE PRESENT INVENTION

It is therefore an object of the present invention to provide a safe and easy method for constructing the foundation system for a manufactured building.

It is another object of the present invention to provide a manufactured building foundation that uses the manufactured building itself as a template for the location and configuration of the concrete footing and skirting pony wall fabrication.

Briefly, a foundation system embodiment of the present invention comprises a prefabricated set of concrete forms and construction plans that permit the construction of a perimeter concrete footing and pony wall while a manufactured building is on-site and in-place. The concrete form set includes standard-length outside-corner, inside-corner and straight sections that bolt together end-to-end immediately below the rim of the manufactured building suspended above the ground at its finished elevation. Adjustments to the standard lengths of the concrete form sections are made by sliding back an end frame on the sidewalls which are made of plywood. The end-frame is resecured with carriage bolts and the excess plywood is trimmed back flush to the end frame. The inside sidewall of each concrete form is tilted back toward the outside perimeter and the outside sidewall is set vertical within both end frames and any intermediate frames. Anchor rings are provided at the ground level of each frame, both inside the inside sidewall and outside the outside sidewall to accommodate four foot lengths of rebar that are driven through the rings into the ground to spike the concrete form to the ground. Jigs are used to suspend anchor bolts in the open tops of the forms between the two sidewalls and rebar that can be suspended longitudinally between the sidewalls by wire from holes provided in each of the end frames and intermediate frames. Once the concrete pour has been made and allowed to set, the concrete forms are unbolted and the ground spikes withdrawn. The tilt in the inside sidewall allows the concrete forms to be easily popped off. The manufactured building is lifted about an inch so a pony wall can then built up using dimensional lumber and plywood between the top of the concrete footing and the bottom rim of the manufactured building. Once the pony wall is finished, the building is allowed to settle back down on it.

An advantage of the present invention is that a manufactured building foundation system is provided in which no major rework of the foundation is required once the building is delivered.

A further advantage of the present invention is that a manufactured building foundation system is provided that allows the construction of the foundation under the manufactured building while in place.

These and many other objects and advantages of the present invention will no doubt become obvious to those of ordinary skill in the art after having read the following detailed description of the preferred embodiments which are illustrated in the drawing figures.

IN THE DRAWINGS

DETAILED DESCRIPTION OF THE PREFERRED EMBODIMENTS

Figure 1:
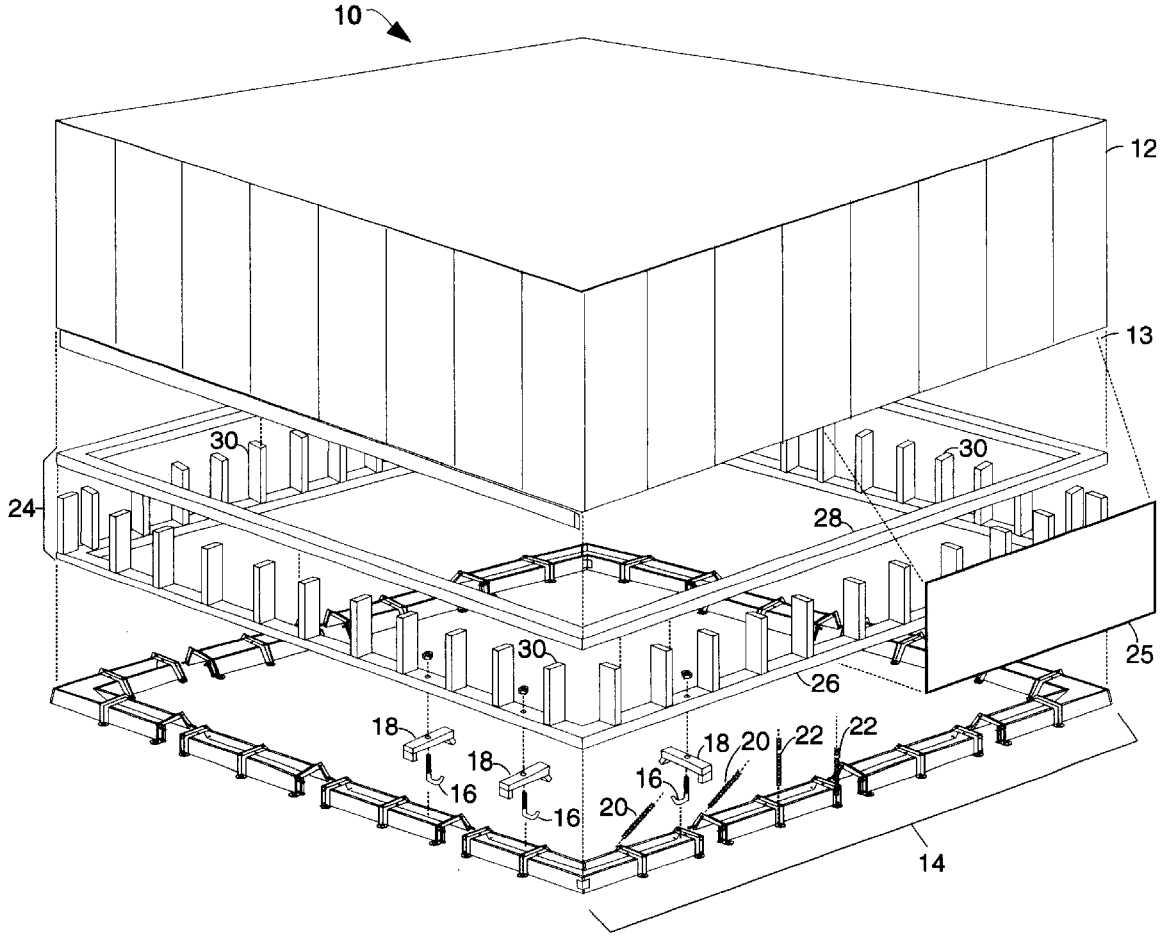
FIG. 1 is a perspective view of a continuous-perimeter foundation system embodiment of the present invention used for a surface installation.

FIG. 1 illustrates a foundation system embodiment of the present invention, referred to herein by the general reference numeral 10. A manufactured building 12 is delivered to a job site and is placed in its desired finished position both in plan and elevation. Hydraulic jacks, for example, are used to level the building 12, and the standard piers suggested by the building manufacturer are placed under the building's transporter beams and any marriage wall when multiple sections are involved. There will typically be two full-length transporter beams per section that are ordinarily the only structural members supported by the manufacturer's suggested foundation installation. The perimeter support is usually quite poor. The present invention adds perimeter support all around the building 12 on which will bear the outside wall loads.

The vertical distance from the ground to the underside of the floor joints preferably does not exceed thirty-six inches (three feet) at any point. Ventilation and access openings in the foundation boundary are roughed-in according to local building codes along the building perimeter. Such are not shown in FIG. 1 in order to show a fully contiguous foundation system.

The foundation system installation begins by checking that the frame of the building is level across three points along each transporter beam, and leveling as necessary. The ground surface is cut and stepped in level segments where it would otherwise exceed a slope of more than one foot in ten feet along the foundation boundary line overshadowed by the building perimeter rim.

In locations that are frost free, the concrete footings for a perimeter foundation and the pads for the internal field piers can lay directly on the surface of the ground. In areas were ground frost is a problem, at least the perimeter foundation must be trenched down to below the frost line so that the concrete footings will not heave and shift during expected winter conditions. In the descriptions that follow, it is assumed that such trenching is already completed in the particular sites where below-the-frost-line footings are required Referring again to FIG. 1, a rim joist 13 is exposed all around the bottom perimeter of the building 12. A concrete form assembly 14 is positioned piece-bypiece beneath the outside perimeter of the building 12. Such concrete form assembly 14 is typically fabricated from ¾" CDX plywood and 1"×1"×8" angle iron. The inside walls of each form section of the concrete form assembly 14 are tilted outwards to help the form release after the concrete pour has set. To further aid such release, the inside of both the inner and outer walls of each form section of the concrete form assembly 14 are prepared by spraying them with a light film of motor oil. The concrete form assembly 14 comprises several kinds of bolt-together form sections that include straight, outside corner, and inside corner sections. Each section is bolted to the next using bolts that are welded to one end of the form section and matching oversized holes in the next section. An impact wrench is useful to make this process go faster. Seismic anchors, e.g., ½" J-bolts 16 are hung from suspension jigs 18 that then are placed to bridge the open tops of the form sections to result in at least a four-inch embedment in the concrete. Ribbons of rebar are hung by wire inside the concrete form assembly 14 longitudinally all around the perimeter. A set of rebar spikes 20 are driven into the ground at an angle to secure the inside walls of the form sections. A number of rings for this purpose are provided in the concrete form assembly 14. Another set of rebar spikes 22 are driven vertically into the ground to secure the outside walls of the form sections.

Once the concrete form assembly 14 is fully assembled and bolted together, a concrete pour is made, preferably by pumping, for example, 2,500 PSI (28-day) concrete into the whole of the form perimeter. The concrete is typically allowed to set seven days before the next construction step involving it is commenced. Once set, the concrete form assembly 14 is disassembled and removed. The angle at which the rebar spikes 20 were driven in helps now in the disassembly because the angle should be sufficient to clear the bottom outside rim of the building 12. In a typical installation, the outside height of the form section wall in the concrete form assembly 14 will be about eight inches, the bottom outside rim of the building 12 will be about twenty-four inches above that.

A pony wall 24 is then constructed between the concrete pour. The pony wall 24 is sheathed to provide for shear strength, e.g., as represented by a plywood section 25 which connects to the rim joist 13 and thus locks the pony wall 24 to the building 12. The pony wall is typically constructed of a green pressuretreated 2"×4" bottom plate 26 and a 2"×4" top plate 28 joined by a system of 2"×4" jack studs 30. The bottom plate 26 is secured to the concrete pour by the J-bolts 16 after having removed the jigs 18. The top plate 28 is secured to the manufactured building 12, e.g., by Simpson A-35F STRONGTIES or plywood shear panels to the rim joists. The outside, and in some instances the inside of the pony wall 24 is sheathed with CDX plywood and nailed according to a shear wall specification that depends on local building codes and the particular loads and wall dimensions peculiar to the installation.

Figure 2:
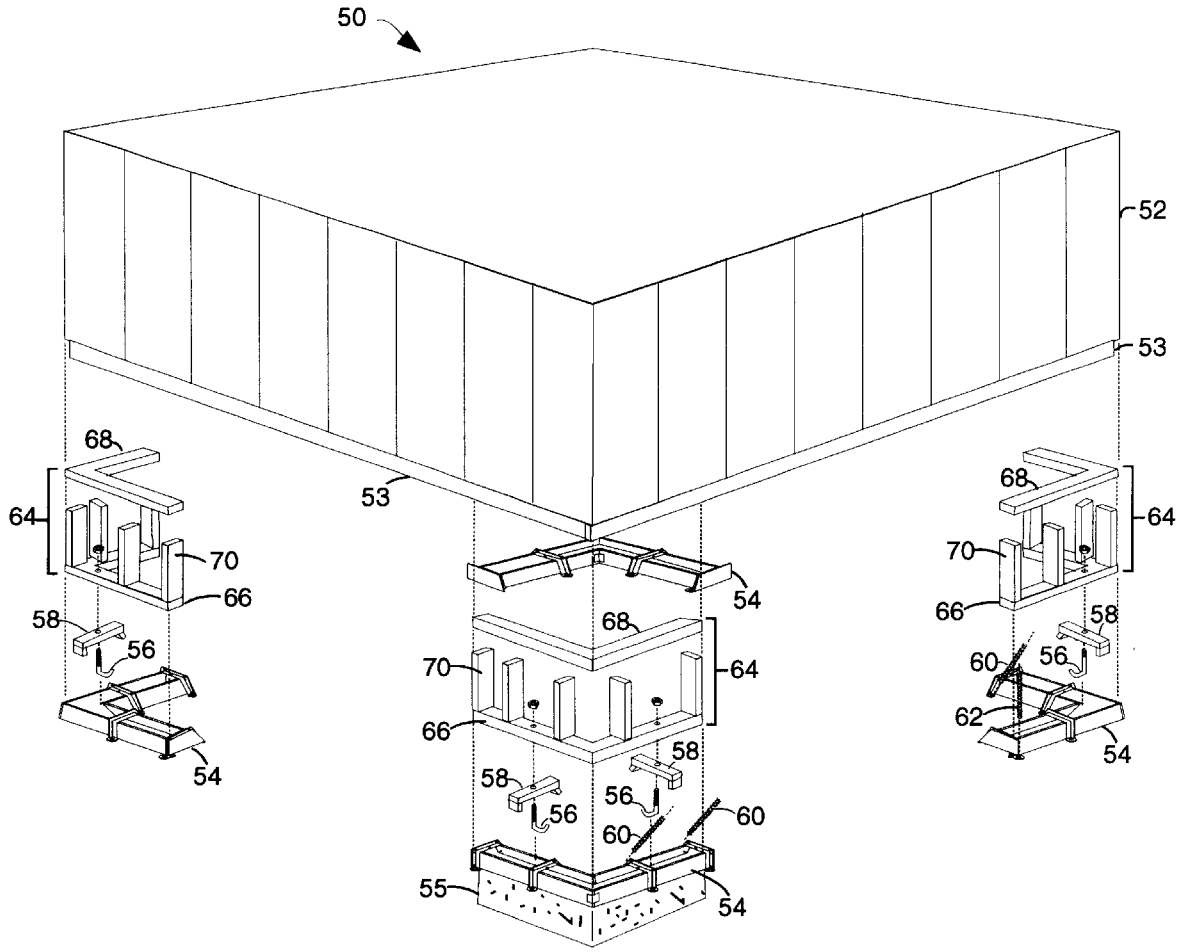
FIG. 2 is a perspective view of a four corner foundation system embodiment of the present invention used where the concrete footings reach down a foot or more below the ground surface.

FIG. 2 illustrates a four-corner foundation system embodiment of the present invention, referred to herein by the general reference numeral 50. A manufactured building 52 is delivered to a job site and is placed in its desired finished position both in plan and elevation. Hydraulic jacks, for example, are used to level the building 52, and the standard piers suggested by the building manufacturer are placed under the building's transporter beams and any marriage wall when multiple sections are involved. There will typically be two full-length transporter beams per section that are ordinarily the only structural members supported by the manufacturer's suggested foundation installation. The perimeter support is usually quite poor. The present invention adds either four-corner or continuous full-perimeter support around the building 52. The outside wall loads can then bear on these in straight vertical lines to the ground support.

The vertical distance from the ground to the underside of the floor joints preferably does not exceed thirty-six inches (three feet) at any point. Ventilation and access openings in the foundation boundary are roughed-in according to local building codes along the building perimeter. Such are not shown in FIG. 2 in order to show a four-corner type foundation system.

The foundation system installation begins by checking that the frame of the building is level across three points along each transporter beam, and leveling as necessary. When the building pad cannot be level across the whole width and length, the ground surface is cut and terraced in level segments where it would otherwise exceed a slope of more than one foot in ten feet along the foundation boundary line overshadowed by the building perimeter rim.

In FIG. 2, a rim joist 53 is exposed all around the bottom perimeter of the building 52. A concrete form assembly 54 is positioned piece-by-piece beneath the outside perimeter at the four corners of the building 52. A typical concrete footing 55 is shown in FIG. 2 to illustrate that the final concrete structure will extend above and below the ground surface.

The concrete form assembly 54 is typically fabricated from ¾" CDX plywood and 1"×1"×8" angle iron. The inside walls of each form section of the concrete form assembly 54 are tilted outwards to help the form release after the concrete pour has set. To further aid such release, the inside of both the inner and outer walls of each form section of the concrete form assembly 54 are prepared by spraying them with a light film of motor oil. The concrete form assembly 54 comprises several kinds of bolt-together form sections that include straight, outside corner, and inside corner sections.

In one embodiment of the present invention, each section is bolted to the next using bolts that are welded to one end of the form section and matching oversized holes in the next section. An impact wrench is useful to make this process go faster. Other means than bolting can be used to hold the sections together.

Seismic anchors, e.g., ½" J-bolts 56 are hung from suspension jigs 58 that then are placed to bridge the open tops of the form sections to result in at least a four-inch embedment in the concrete. Ribbons of rebar are hung by wire inside the concrete form assembly 54 longitudinally all around the perimeter. A set of rebar spikes 60 are driven into the ground at an angle to secure the inside walls of the form sections. A number of rings for this purpose are provided in the concrete form assembly 54. Another set of rebar spikes 62 are driven vertically into the ground to secure the outside walls of the form sections.

Once the concrete form assembly 54 is fully assembled and bolted together, a concrete pour is made, preferably by pumping, for example, 2,500 PSI (28-day) concrete into the whole of the form perimeter. The concrete is typically allowed to set seven days before the next construction step involving it is commenced. Once set, the concrete form assembly 54 is disassembled and removed. The angle at which the rebar spikes 60 were driven in helps now in the disassembly because the angle should be sufficient to clear the bottom outside rim of the building 52. In a typical installation, the outside height of the form section wall in the concrete form assembly 54 will be about eight inches, the bottom outside rim of the building 52 will be about twenty-four inches above that.

When using the four-corner system, long unsupported runs between the corners can occur that need to be braced in both the transverse and longitudinal directions with shear panels on island pony walls. For example, a typical double-wide house 49' to 60' long will need about eight transverse bracing walls and four longitudinal walls. Each wall will have one side sheathed with 4"×4" framing at each end, 3" on-center nailing, PAHD42 hold-downs, 14" on-center anchor spacing, and 12" on-center Simpson A35F spacing. Other house widths and lengths are similarly specified.

A pony wall 64 is then constructed between the concrete pour. The pony wall is typically constructed of a 2"×4" bottom plate 66 and a 2"×4" top plate 68 joined by a system of 2"×4" jack studs 70. The bottom plate 66 is secured to the concrete pour by the J-bolts 56 after having removed the jigs 58. The top plate 68 is secured to the manufactured building 52, e.g., by shear panels or metal ties that lock-in the flooring system of the building and its walls. The outside, and in some instances the inside of the pony wall 64 is sheathed with 4' lineal length CDX plywood and nailed according to a shear wall specification that depends on local building codes and the particular loads and wall dimensions peculiar to the installation.

Figure 3:
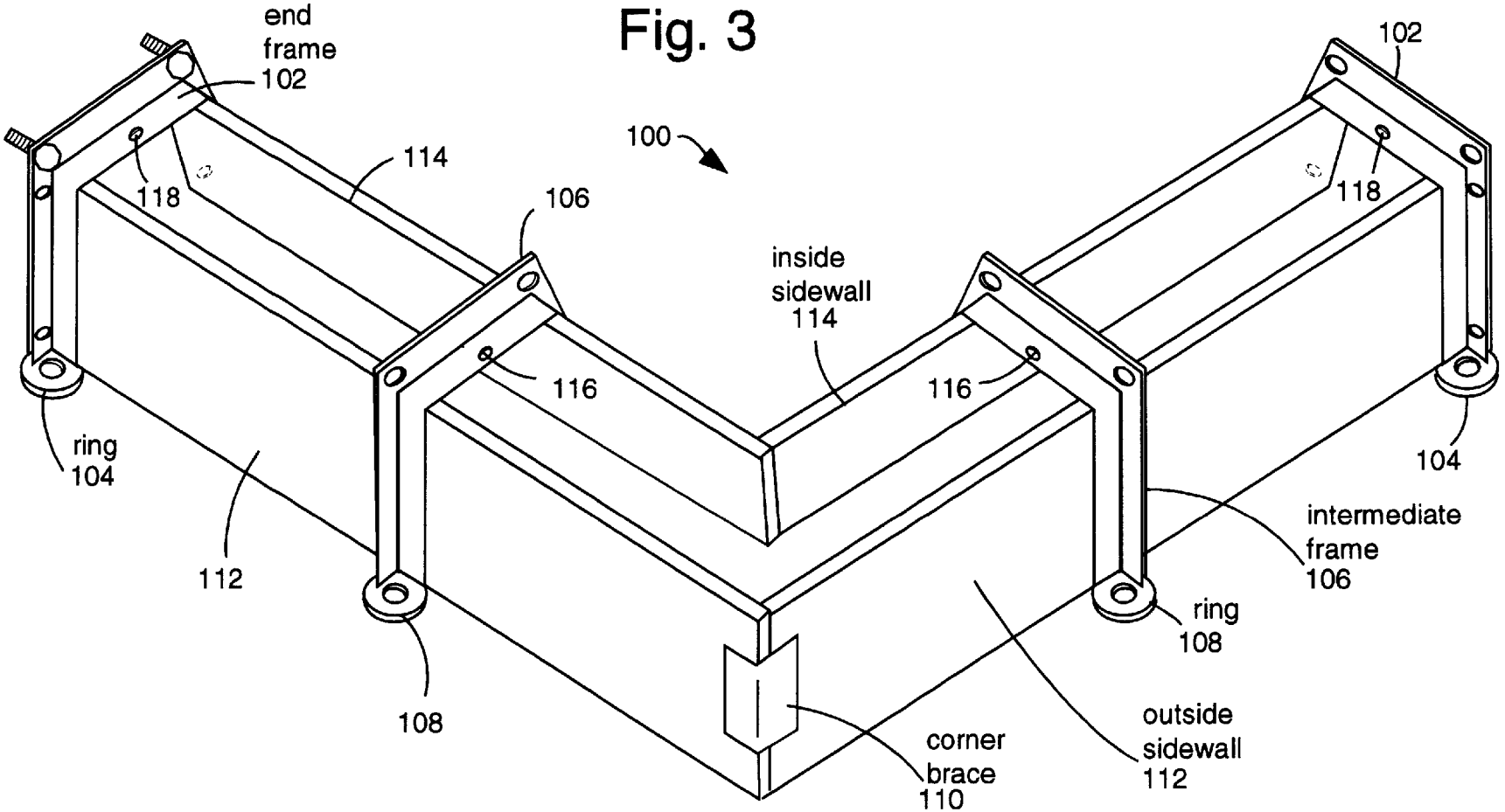
FIG. 3 is a perspective view of an outside corner concrete form section included in the foundation systems of FIGS. 1 and 2.

FIG. 3 is a perspective view of an outside corner concrete form section 100, e.g., as included in the foundation systems of FIGS. 1 and 2. The outside corner concrete form section 100 includes a pair of end frames 102 with a ground spike ring 104 located at the bottom of both the inside and outside ends. The ring 104 is typically a large washer welded to the end frame 102 and has a hole large enough to pass through a length of rebar or other ground spiking rod. A pair of intermediate frames 106 also each have a pair of ground spike rings 108, one inside and one outside. A corner brace 110 is typically carriage bolted to a pair of outside sidewalls 112. Such sidewalls 112 are intended to be vertical when the concrete footing pour is being made through the open top between the outside sidewall 112 and a pair of inside sidewalls 114. The inside sidewalls 114 must be titled with their tops outward by about 15° from vertical in order to provide clear access to the inside ground spike ring 104 (not visible in FIG. 3) and to allow the form to release from the concrete once it sets. On end, the cross section of the outside corner concrete form section 100 is a trapezoid, with parallel top and bottom runs, and where the top run is shorter than the bottom run. The bottom run to the outside wall forms a right angle, and the bottom run to the inside wall forms an acute angle. Carriage bolts can also be used to secure the intermediate and end frames 106 and 102 to each of the inside and outside sidewalls 114 and 112. A set of holes 116 and 118 in the frames 106 and 102 allow a length of rebar to be longitudinally suspended by wire inside and between the sidewalls 112 and 114. Such reinforcing is ordinarily required to give the concrete footing a measure of tensile strength.

Plywood can be used to construct the inside and outside sidewalls 114 and 112, and will usually be ¾" thick and stand 8" tall. The lengths can vary, in the outside corner concrete form section 100, a standard outside run of four feet on each side would be good. Where a particular installation requires a length adjustment, the respective end frame 102 is unbolted from the inside and outside sidewalls 114 and 112 and is moved back and remounted at the required longitudinal position. The plywood of the inside and outside sidewalls 114 and 112 is then trimmed short to be flush with the outside flange of the end frame 102.

In alternative embodiments of the present invention, the inside and outside sidewalls 114 and 112 can be made of steel sheet and configured to longitudinally slip in and out so adjustments can be made in the run lengths without having to cut or otherwise permanently alter the form.

Figure 4:
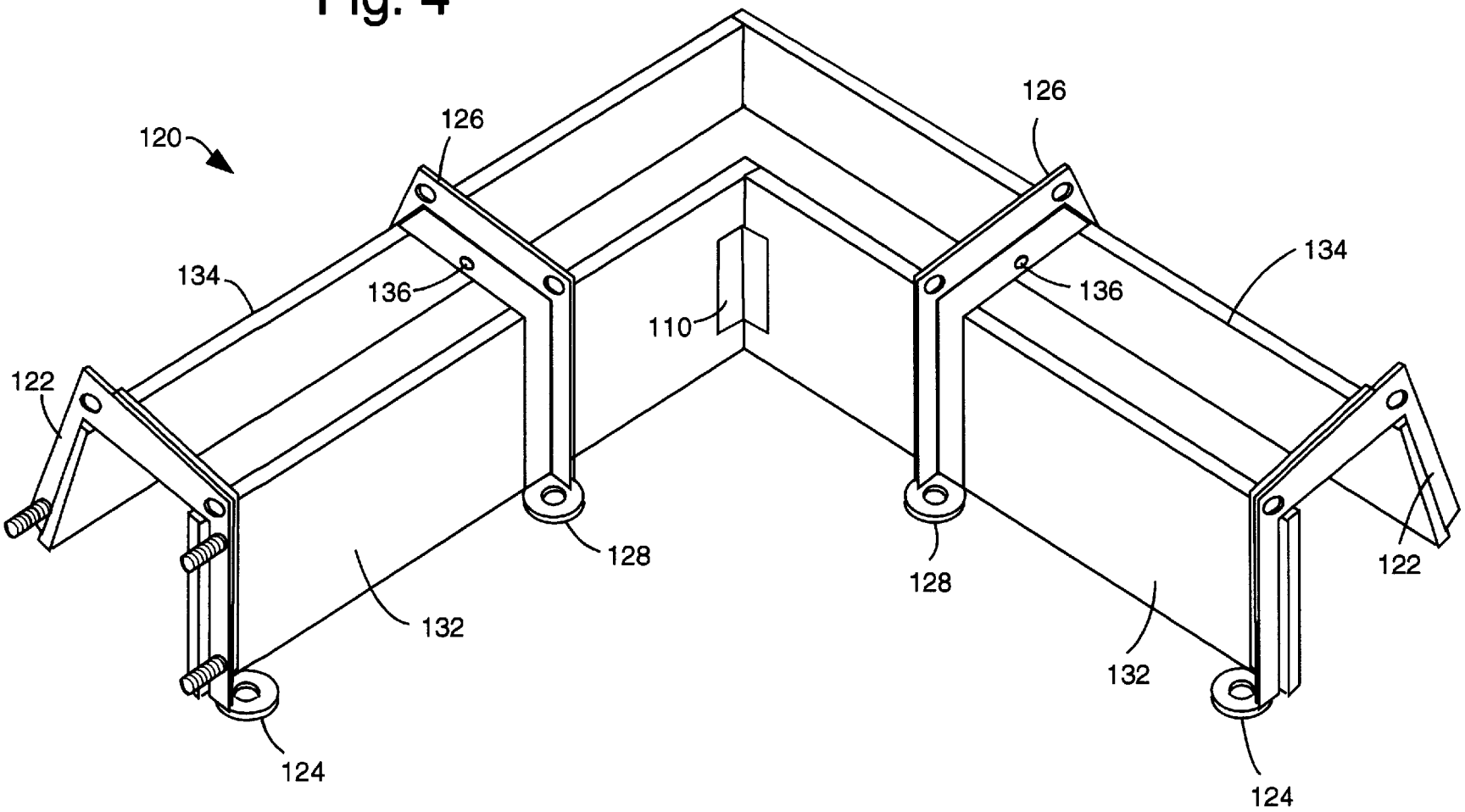
FIG. 4 is a perspective view of an inside corner concrete form section included in the foundation systems of FIGS. 1 and 2.

FIG. 4 is a perspective view of an inside corner concrete form section 120, e.g., as could be included in the foundation systems of FIGS. 1 and 2. The inside corner concrete form section 120 includes a pair of end frames 122 with a ground spike ring 124 located at the bottom of both the inside (not visible) and outside ends. The ring 124 is typically a large washer welded to the end frame 122 and has a hole large enough to pass through a length of rebar or other ground spiking rod. A pair of intermediate frames 126 also each have a pair of ground spike rings 128, one inside and one outside. A corner brace 130 is typically carriage bolted to a pair of outside sidewalls 132. Such sidewalls 132 are intended to be vertical when the concrete footing pour is being made through the open top between the outside sidewall 132 and a pair of inside sidewalls 134. The inside sidewalls 134 must be titled with their tops outward by about 15° from vertical in order to provide clear access to the inside ground spike ring 124 (not visible in FIG. 3) and to allow the form to release from the concrete once it sets. On end, the cross section of the inside corner concrete form section 120 is a trapezoid, with parallel top and bottom runs, and where the top run is shorter than the bottom run. The bottom run to the outside wall forms a right angle, and the bottom run to the inside wall forms an acute angle. Carriage bolts can also be used to secure the intermediate and end frames 126 and 122 to each of the inside and outside sidewalls 134 and 132. A set of holes 136 in the frames 126 allow a length of rebar to be longitudinally suspended by wire inside and between the sidewalls 132 and 134.

Plywood can be used to construct the inside and outside sidewalls 134 and 132, and will usually be ¾" thick and stand 8" tall. The lengths can vary, in the inside corner concrete form section 120, a standard outside run of four feet on each side would be good. Where a particular installation requires a length adjustment, the respective end frame 122 is unbolted from the inside and outside sidewalls 134 and 132 and is moved back and remounted at the required longitudinal position. The plywood of the inside and outside sidewalls 134 and 132 is then trimmed short to be flush with the outside flange of the end frame 122.

In alternative embodiments of the present invention, the inside and outside sidewalls 134 and 132 can be made of steel sheet and configured to longitudinally slip in and out so adjustments can be made in the run lengths without having to cut or otherwise permanently alter the form.

Figure 5:
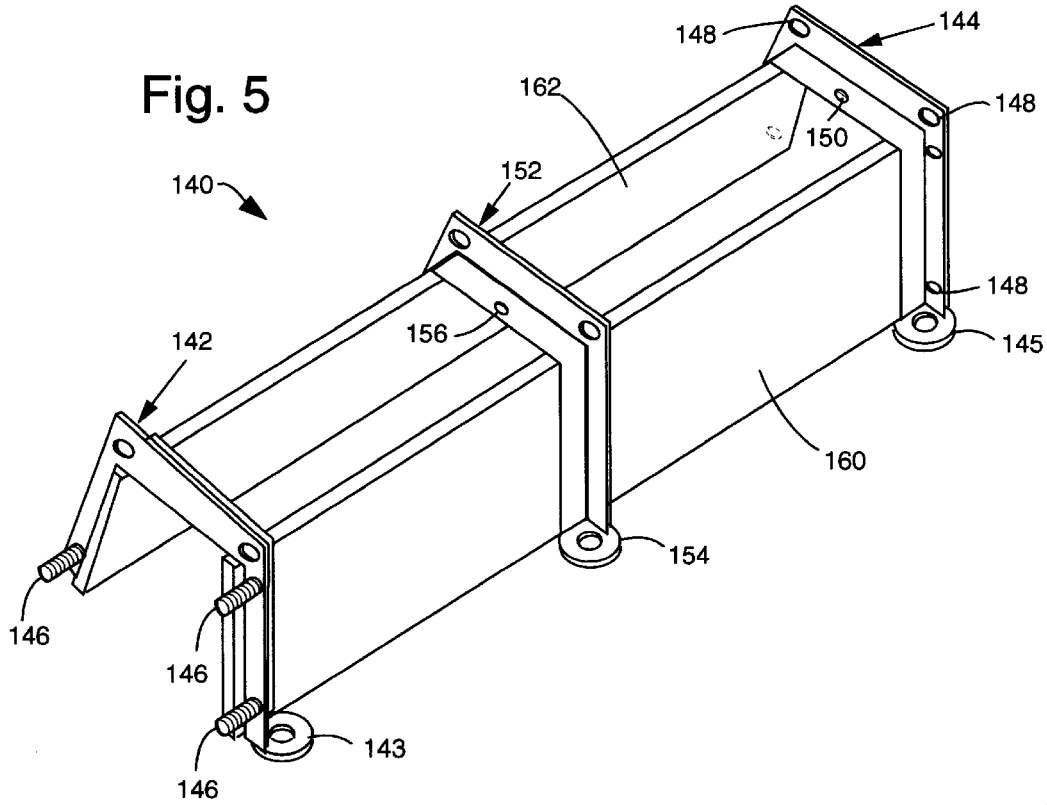
FIG. 5 is a perspective view of a straight concrete form section included in the foundation systems of FIG. 1.

FIG. 5 is a perspective view of a straight concrete form section 140 included in the foundation system of FIG. 1. The straight concrete form section 140 includes an end frame 142 with a pair of ground spike rings 143 located at the bottom of both the inside (not visible) and outside ends. Another end frame 144 is included at the opposite end and also has a pair of ground spike rings 145. The rings 143 and 145 are typically large washers welded to the end frame 142 and 144 and have a hole large enough to pass through a length of rebar or other ground spiking rod. The end frame 142 has a set of three bolts 146 that are arranged in a standard pattern to engage all the mating end frames in the system 10, e.g., end frames 104, 122, and an end frame 148. Such end frames have a matching pattern of larger bolt holes 148. In use, an impact wrench is used to assemble and disassemble such end frames in respective sections bolt-by-bolt. A hole 150, e.g., shown in end frames 144, allows a length of rebar to be longitudinally suspended by wire inside.

An intermediate frame 152 also has a pair of ground spike rings 154, one inside and one outside, and gives support in the middle to an outside and an inside pair of sidewalls 160 and 162. Such sidewall 160 is intended to be vertical when the concrete footing pour is being made through the open top between the outside sidewall 160 and the inside sidewalls 162. The inside sidewall 162 must be titled with its top outward by about 15° from vertical in order to provide clear access to the inside ground spike rings 143, 145, and 154 (not visible in FIG. 5) and to allow the form to release once the concrete sets. On end, the cross section of the straight concrete form section 140 is a trapezoid, with parallel top and bottom runs, and where the top run is shorter than the bottom run. The bottom run to the outside wall forms a right angle, and the bottom run to the inside wall forms an acute angle. Carriage bolts can also be used to secure the intermediate and end frames 142, 144 and 152 to each of the inside and outside sidewall 160 and 162.

Plywood can be used to construct the inside and outside sidewall 160 and 162, and will usually be ¾" thick and stand 8" tall. The lengths can vary, in the straight concrete form section 140, a standard outside run of four feet on each side would be good. Where a particular installation requires a length adjustment, the respective end frame 142 or 144 is unbolted from the inside and outside sidewall 160 and 162 and is moved back and remounted at the required longitudinal position. The plywood of the inside and outside sidewall 160 and 162 is then trimmed short to be flush with the outside flange of the end frame 142 and 144.

In alternative embodiments of the present invention, the inside and outside sidewall 160 and 162 can be made of steel sheet and configured to longitudinally slip in and out so adjustments can be made in the run lengths without having to cut or otherwise permanently alter the form.

Figure 6:
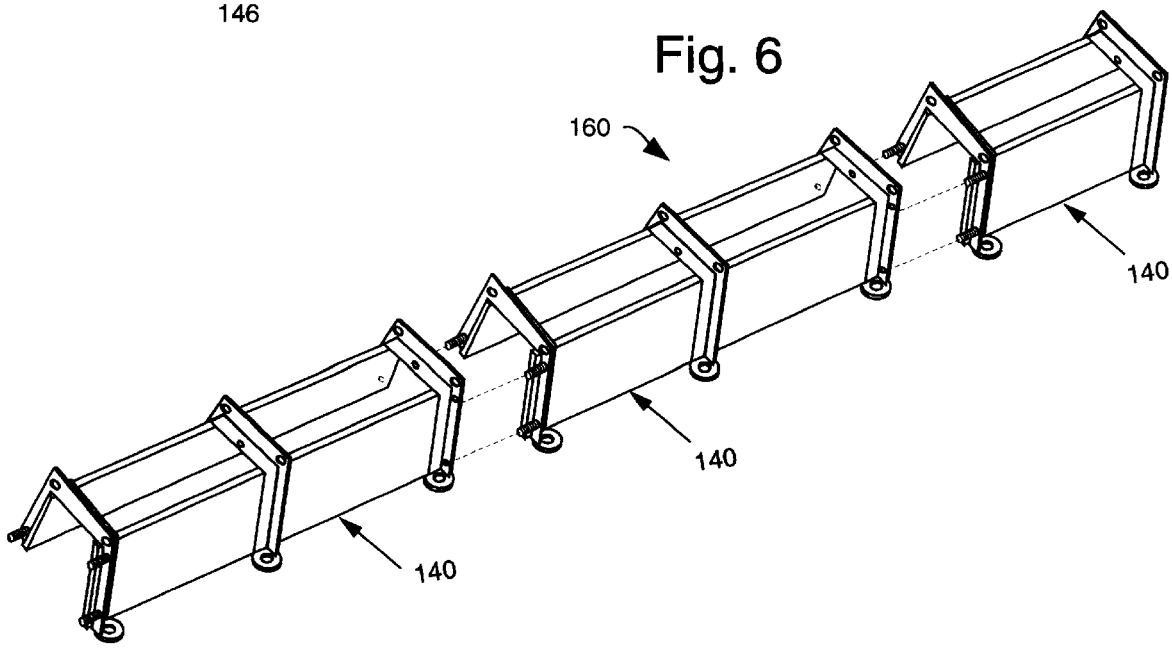
FIG. 6 is an exploded assembly perspective view of several of the straight concrete form sections of FIG. 5 being butted together and bolted head-to-toe using standardized bolt patterns in the flanges of the end frames.

FIG. 6 is an exploded assembly perspective view of a run 160, comprising several of the straight concrete form sections 140 being butted together and bolted head-to-toe using standardized bolt patterns in the flanges of the end frames.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method to permit the construction of a perimeter concrete footing and pony wall while a manufactured building is on-site and in-place, comprising the steps of:

situating a concrete form set that includes uniform-length outside-corner, inside-corner and straight sections that bolt together end-to-end immediately below the rim of the manufactured building which is previously suspended above the ground at its desired-finished elevation, wherein, an inside sidewall of each concrete form is tilted back toward the outside perimeter and an outside sidewall is set vertical within a pair of end frames and any intermediate frames;

adjusting the uniform-lengths of said concrete form sections by sliding back an end frame on the sidewalls and re-securing, wherein any excess of sidewall is trimmed back flush to said end frame; and spiking said concrete form set to the ground through a set of anchor rings provided at the ground level of each frame, both inside an inside sidewall and outside an outside sidewall to accommodate.

2. The method of claim 1, further comprising:

using a jig that provides for the suspension of a plurality of anchor bolts in the open tops of said concrete form sections between said inside and outside sidewalls.

3. The method of claim 1, wherein:

using a hole provided in each of said pair of end frames to suspend a rebar longitudinally between said inside and outside sidewalls by wire from holes provided in each of the end frames and any intermediate frames.

* * * * *